United States Patent [19]

Giacopelli

[11] 4,028,208

[45] June 7, 1977

[54] ELECTROLYTE CELL WITH VERTICAL ELECTRODES

[75] Inventor: Umberto Giacopelli, Rosignano-Solvay (Leghorn), Italy

[73] Assignee: Solvay & Cie, Belgium

[22] Filed: Nov. 18, 1975

[21] Appl. No.: 633,104

[30] Foreign Application Priority Data

Dec. 16, 1974 France ..... 74.41708

[52] U.S. Cl. ..... 204/252; 204/266; 204/286

[51] Int. Cl.[2] ..... B01K 3/10

[58] Field of Search ..... 204/266, 252, 286, 275

[56] References Cited

UNITED STATES PATENTS

| | | | |
|---|---|---|---|
| 3,642,604 | 2/1972 | Giacopelli | 204/286 |
| 3,700,582 | 10/1972 | Giacopelli | 204/275 |
| 3,743,592 | 7/1973 | Metcalff | 204/266 |

FOREIGN PATENTS OR APPLICATIONS

| | | | |
|---|---|---|---|
| 1,160,999 | 8/1969 | United Kingdom | 204/266 |

*Primary Examiner*—Anthony Skapars
*Attorney, Agent, or Firm*—Robert E. Burns; Emmanuel J. Lobato; Bruce L. Adams

[57] ABSTRACT

The invention relates to improvements in electrolytic cells with vertical metal anode plates, such as diaphragm cells for the electrolysis of a brine. The cell according to the invention comprises a baseplate with slots passing therethrough and anode plates which pass through the slots in the baseplate and which are connected to a current lead-in disposed beneath the baseplate. Sealing joints are interposed between the anode plates and the faces of the slots and are supported by the current lead-in.

22 Claims, 10 Drawing Figures

ELECTROLYTE CELL WITH VERTICAL ELECTRODES

BACKGROUND OF THE INVENTION

The present invention is directed to improving electrolytic cells with vertical electrodes, more particularly cells equipped with metal anodes and intended for example for the production of alkali metal chlorate or hypochlorite, or for the production of chlorine.

It is known to employ metal anodes in cells for the electrolysis of aqueous solutions of alkali metal halides. These anodes are usually made up of plates of a film-forming metal or an alloy of a film-forming metal covered, at least partially, with an active coating which catalyses the discharge of halide ions.

Until now, the development of cells with metal anodes has been checked by the difficulties encountered in fixing the anodes within the cell and in connecting them to a current lead-in.

In British Pat. No. 1,160,999 applied for on May 2, 1967 in the name of IMPERIAL METAL INDUSTRIES (KYNOCH)LIMITED, there is proposed an anode assembly for an electrolytic cell, wherein substantially vertical and parallel anode plates are clamped between horizontal beams, made of an electrically non-conducting material, which form the base of the cell, and the anodes are connected to one or more current lead-in bus-bars extending beneath the beams. The pressure of the beams on the anode plates is sufficient to support the anodes and the bus-bars connected to them, and to ensure the fluid-tightness of the base of the cell.

This known anode assembly has the advantage of permitting quick and easy assembly and dismantling of the anodes in the cell.

A major disadvantage of this known anode assembly nevertheless resides in the difficulty of ensuring effective and durable fluid-tightness between the anode plates and the beams forming the base of the cell. The sealing joints interposed between the anode plates and the beams are in fact strongly acted upon by the large hydrostatic pressure, the high temperature and the corrosive nature of the electrolyte. These joints must be greatly compressed, beyond their elastic limit, so as on the one hand to prevent their expulsion under the effect of the hydrostatic pressure and on the other hand to prevent sliding of the anodes between the beams.

SUMMARY OF THE INVENTION

The invention overcomes the aforesaid disadvantage of the known cells.

To this end tne invention relates to an electrolytic cell comprising a baseplate with slots passing therethrough and anode plates which pass through the slots in the baseplate, with sealing joints interposed between the anode plates and the faces of the slots, and which are connected to a current lead-in disposed beneath the baseplate.

According to the invention, the sealing joints are supported by the current lead-in.

The anode plates used in the invention may be made of a film-forming metal or of an alloy of a film-forming metal and covered, at least partially, with an active coating which catalyses the discharge of halide ions.

By a film-forming metal is meant an electrically conducting metal which, when used as anode in the electrolyte, spontaneously forms on itself a coating of an impermeable film which has a high electrical resistance. In practice, the film-forming metals used in electrolytic cells are chosen from the group consisting of titanium tantalum, niobium, zirconium, tungsten and their alloys.

The active coating of the anode is a coating which resists corrosion by the electrolyte and the products of electrolysis, and which takes part in the conduction of the electric current between the underlying adjacent film-forming material of the anode and the electrolyte. In practive, the active coating comprises a metal or a compound of a metal of the platinum group; it comprises for example a mixture of ruthenium oxide and titanium dioxide.

Underneath the film-forming metal, these metal anodes sometimes contain a core of a material which is a better electrical conductor and cheaper, such as copper or aluminum.

In the cell according to the invention, the sealing joints between the anode plates and the baseplate have their lower portion resting on the current lead-in. Because of this it is impossible for them to be expelled under the effect of the hydrostatic pressure to which they are subjected in the cell.

The cell according to the invention thus has the advantage of allowing a reduction of the compression of the sealing joints; it allows this compression to be reduced for example considerably below the elastic limit of the joints, and this reduces the stresses on the joints in service, improves the fluid-tightness of the cell and increases the life of the joints.

In one embodiment of the cell according to the invention, the current lead-in and the baseplate may both be supported on a common foundation, the sealing joints being compressed in the slots of the baseplate, between the anode plates and the current lead-in, by the action of the cell's own weight.

In another embodiment of the cell according to the invention, which is preferred, the current lead-in is clamped against the sealing joints by means of a group of bolts and nuts uniting the current lead-in with the baseplate. The baseplate rests, for example at its periphery, on a foundation and supports the assembly of anodes and current lead-in by way of the group of bolts and nuts. This embodiment of the invention has the advantage of allowing precise control of the compressive stresses on the sealing joints.

In order to render uniform the forces of compression in the joints and to improve the fluid-tightness of the cell, it is advantageous, according to the invention, to give the slots in the baseplate a trapezoidal transverse section and to use joints of corresponding transverse section.

In the cell according to the invention, the baseplate may be monolithic or, alternatively, it may be made up from a group of prefabricated beams shaped so that after assembly they form between them to the aforesaid slots intended for the anodes to pass therethrough. The baseplate is preferably made of a material that can be shaped by pouring, such as, for example, concrete, cast iron or, preferably, a laminate of polyester and glass fibres.

The current lead-in may consist of one or more metal plates, for example of copper or aluminium, fixed to the lower part of the anodes.

According to a preferred embodiment of the invention, the current lead-in comprises, in known manner, metal bars extending between the anode plates and clamped between these plates so as to form a rigid assembly.

The sealing joints interposed between the baseplate and the anodes are preferably made of a resilient material which is resistant to corrosion, for example a synthetic rubber such as an elastomeric copolymer of ethylene and propylene known under the trade mark DUTRAL (Montecatini-Edison) or an elastomeric copolymer of vinylidene fluoride and hexafluoropropene known under the trade mark VITON (E.I. du Pont de Nemours & Co).

In order to construct the cell according to the invention, these are separately made on the one hand an assembly of the anode plates with the current lead-in and on the other hand the baseplate. The anode assembly is then placed on a suitable support, so that the anodes are substantially vertical, then the aforesaid sealing joints are placed around each anode plate. Then the baseplate is brought into engagement around the anode plates by passing the latter through the slots in the baseplate.

In the case where the baseplate is made up of a group of prefabricated beams, these may be assembled together to form the baseplate before engaging this around the anodes. As a variant, the beams may also be inserted individually between the anode plates, then connected together to form the baseplate.

BRIEF DESCRIPTION OF THE DRAWING

Features and details of the invention will become evident from the following description of the appended figures, which represent several embodiments of the cell according to the invention.

DESCRIPTION OF THE PREFERRED EMBODIMENTS

Figure 1:
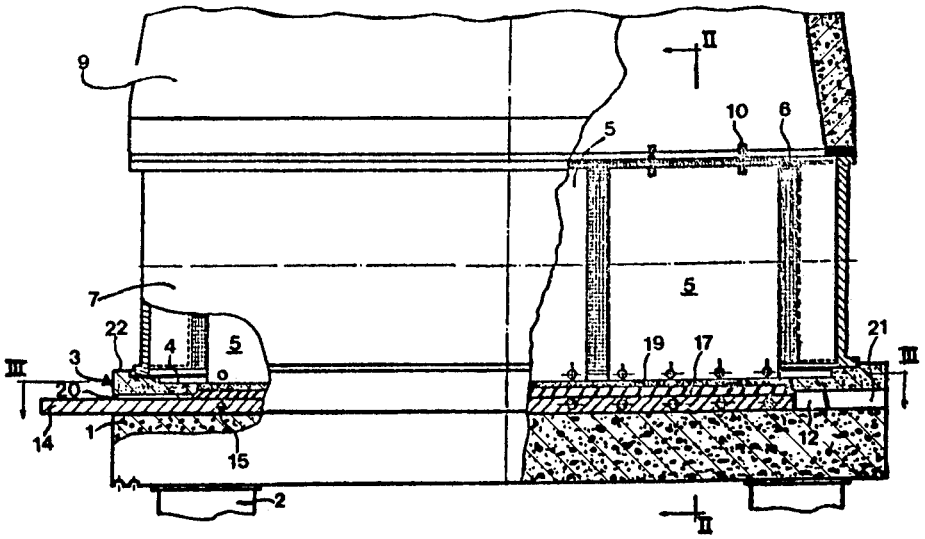
FIG. 1 shows in longitudinal elevation, partially cut away, a first embodiment of the cell according to the invention.

In these figures the same reference numerals denote the same elements.

In FIGS. 1–4, there is shown a diaphragm cell intended particularly for the electrolysis of an aqueous solution of alkali metal halide, for example a sodium chloride or potassium chloride brine. The cell comprises, on a foundation 1 of reinforced concrete, supported by insulators 2, a baseplate 3 forming the floor 4 of the cell.

Above the baseplate 3 stretches a series of parallel rows of vertical anode plates 5 made of metal, alternating with cathode pockets 6 having foraminous walls of steel.

The anode plates 5 are advantageously titanium plates covered with a coating which catalyses the discharge of halide ions, for example a coating containing a metal of the platinum group or a compound of a metal of the platinum group.

The cathode pockets 6 may be formed of a steel lattice. They are covered, on their outer surface, facing towards the anodes 5, by a diaphragm (not shown). They are attached to the interior of a fluid-tight casing 7 made of steel, which is supported by the periphery of the baseplate 3 and is closed by a fluid-tight cover 9 (part shown).

Cross-members 10 made of an insulating material which is resistant to corrosion, for example chlorinated polyvinyl chloride, ride on the cathode pockets 6 and are fitted on to the anode plates 5, so as to maintain the spacing between the anodes and the cathodes substantially constant.

The cover 9 is in communication, at its upper part, with a conduit for admission of the solution to be electrolysed and with a conduit for removal of the halogen produced at the anodes. The cathode casing 7 is also in communication with a conduit 8 for removal of the hydrogen produced at the cathodes and with a conduit 11 for removal of an alkaline liquor.

The baseplate 3 is made of a concrete in which the binder is a polyester resin known under the trade mark ATLAC (Atlas Chemical Industries), resistant to the corrosive action of the solution submitted to electrolysis. The baseplate rests on the foundation 1 at its periphery and form, between itself and the foundation, a longitudinal cavity 12.

The baseplate 3 is perforated by a series of parallel, longitudinal slots 13, having a trapezoidal transverse section, the width of which decreases, from bottom to top. Each of the slots 13 is traversed by a row of three anodes 5. The anode plates are inserted and clamped, at their lower part, between longitudinal bars 14 made of copper or aluminum, by means of threaded rods 15 and nuts 16. The bars 14 are resting on the foundation 1 and extend within the cavity 12 underneath the floor 4 of the cell. They serve as current lead-ins to the anode plates 5 and project beyond one side of the baseplate for connection to a source of current or in series to another electrolytic cell.

According to the invention, sealing betwen the anode plates 5 and the baseplate 3 is effected by means of resilient fluid-tight joints 17 inserted around the anode plates 5, in the slots 13.

Figure 5:
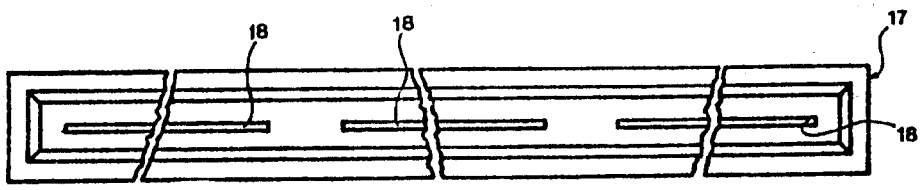
FIG. 5 is a plan view of a sealing joint employed between a row of anodes and the baseplate of the cell of FIGS. 1 – 4.
Figure 6:
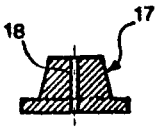
FIG. 6 is a transverse vertical section in the plane VI—VI of FIG. 5.

A joint 17 is shown on a large scale in FIGS. 5 and 6. This joint consists of an elastic strip of a material that is resistant to the corrosion action of the electrolyte, for example an elastomeric copolymer of ethylene and propylene known under the trade mark DUTRAL (Montecatini-Edison) or an elastomeric copolymer of vinylidene fluoride and hexafluoropropene known under the trade mark VITON (E.I. du Pont de Nemours & Co).

The elastic strip 17 has a trapezoidal transverse section corresponding substantially to the trapezoidal section of the slots 13. It is perforated by three axial slots 18 designed for passage of the three anode plates 5 which pass through the corresponding slot 13 of the baseplate 3.

The joints 17 are inserted around the anode plates 5 and elastically compressed in the slots 13 of the baseplate, against the anode plates 5 and against the metal bars 14 under the action of the cell's own weight.

In a modified form, the slots 13 may be filled up, above the elastic joints 17, with a quantity of leak-proof filler 19, made of a corrosion resistant material. This filling material 19 may consist, for example, of a cold-vulcanising elastomer poured into the slots 13, on top of the joints 17, and polymerised in situ in contact with the ambiant air, such as depolymerised rubber known under the names LORIVAL (Lorival Plastics) and DPR (H.V. Hardman & Co.).

In the embodiment that has been described, the cavity 12 is advantageously open at its two opposite ends 20 and 21, so as to form a conduit for ventilation of the metal bars 14.

Figure 2:
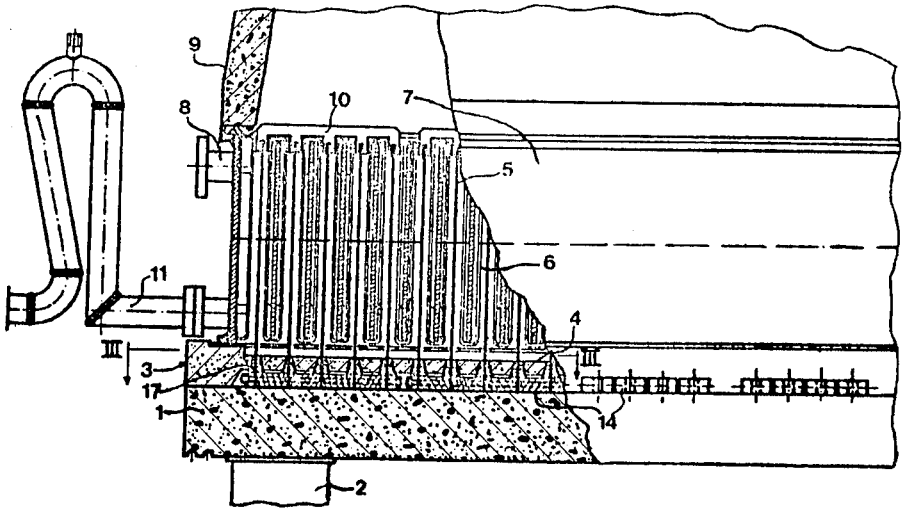
FIG. 2 shows in transverse elevation, partially cut away, a part of the cell of FIG. 1.
Figure 3:
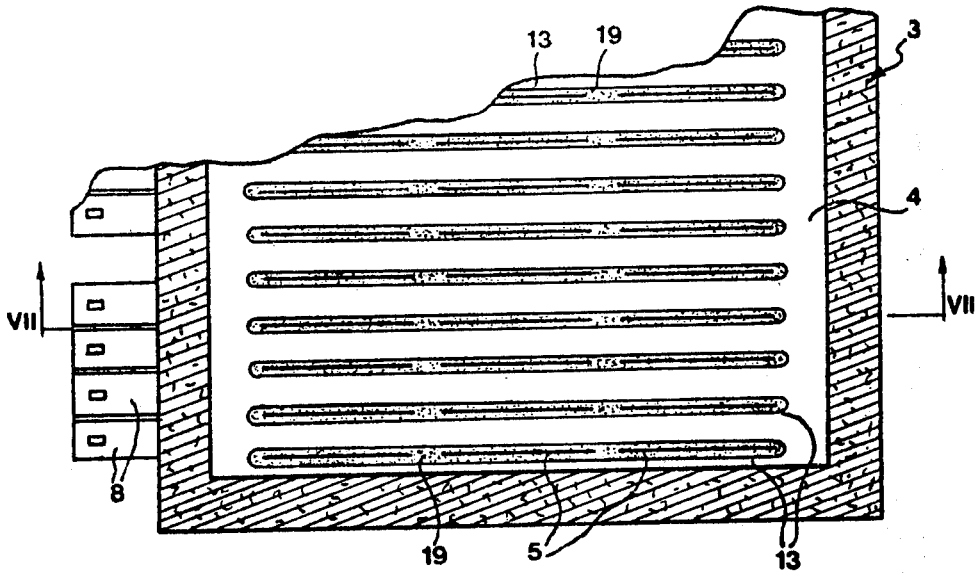
FIG. 3 is a horizontal section in the plane III—III of FIGS. 1 and 2.
Figure 4:
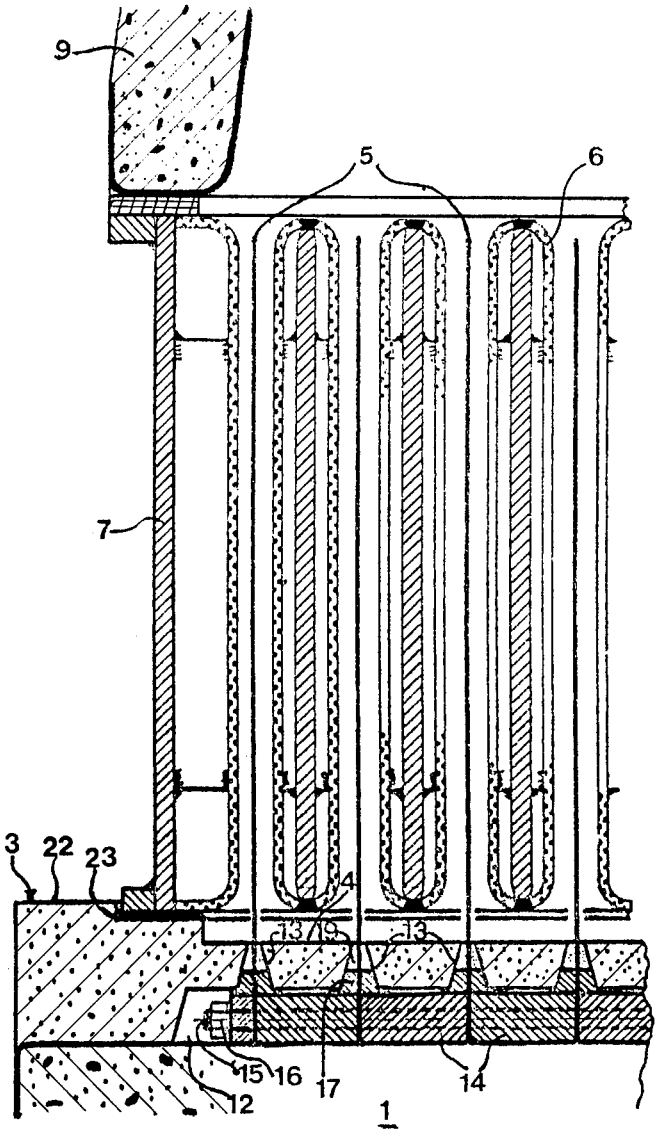
FIG. 4 shows a detail of FIG. 2 on a larger scale.

In accordance with an advantageous modification of the embodiment which has been described, seen in FIGS. 2 and 3, the rows of anode plates 5 and the bars 14 are divided into several distinct anode assemblies, independent from each other. This modification of the invention has the two-fold advantage of easing the construction of the cell and reducing the expansion of the anode assemblies as the result of their heating by Joule effect.

In another advantageous modification of the embodiment that has been described, the baseplate 3 has a peripheral shoulder 22 for lateral retention of a peripheral joint 23 ensuring sealing between the baseplate 3 and the cathode casing 7.

Figure 7:
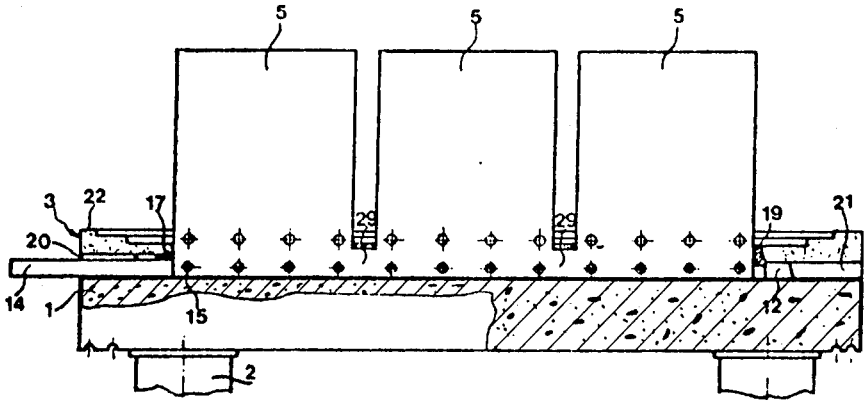
FIG. 7 is a transverse vertical section, in the plane VII—VII of FIG. 3, in a modified construction of the cell of FIGS. 1 – 4.

In a modified form of construction, shown in FIG. 7, the three plates 5 of each row of anodes are joined together by junction plates 29 of titanium, which extend within the slot 13 of the baseplate 3 through which the row of anodes passes. The sealing joint 17, shown in FIG. 8, is perforated by a single axial slot 30, traversed by the assembly of the three anode plates 5 and the junction plates 29.

Figure 8:
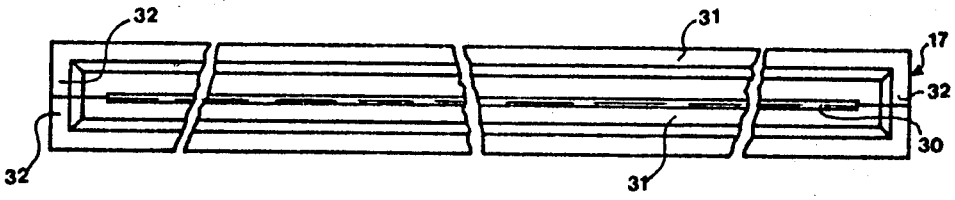
FIG. 8 is a plan view of the sealing joint employed between a row of anodes and the baseplate of the cell of FIG. 7.

In a modification, the joint 17 of FIG. 8 may be formed of two independent strips 31 fitted against each other along two end-shoulders 32 so as to delimit between them the axial slot 30.

Figure 9:
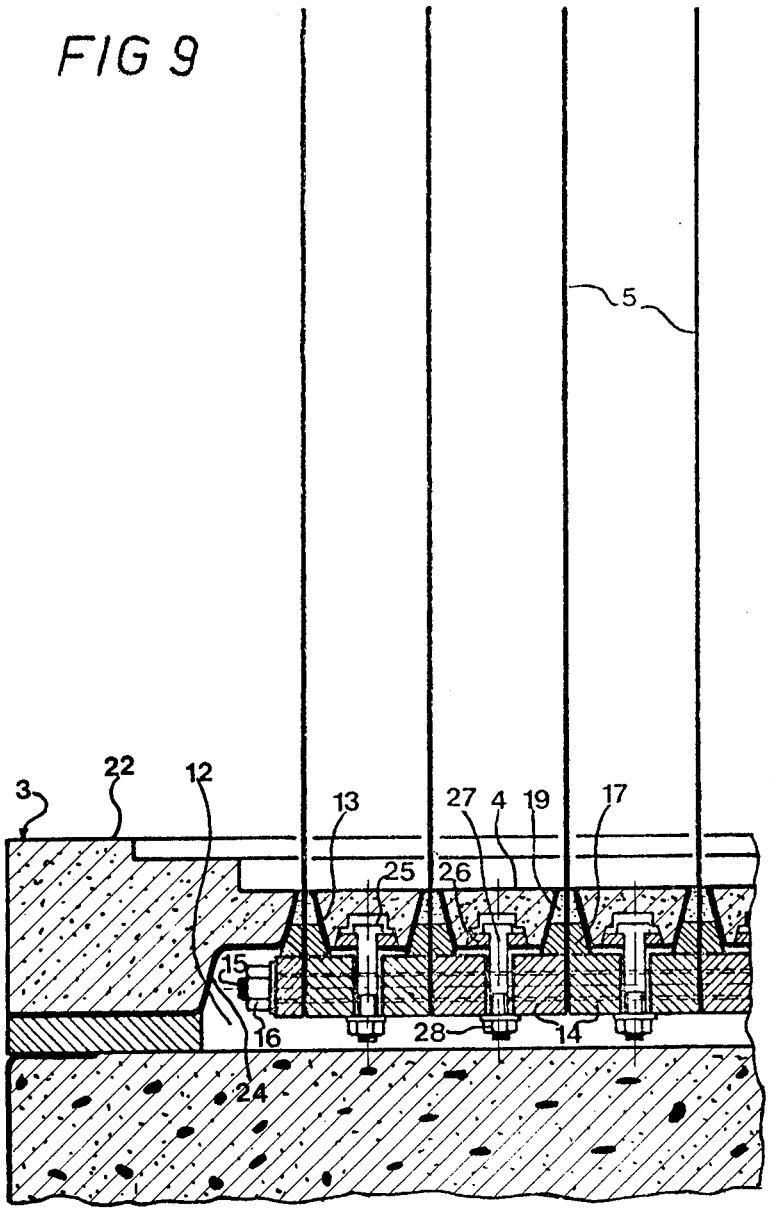
FIG. 9 is a view, analogous to FIG. 4, of a second embodiment of the cell according to the invention.

In FIG. 9 is shown the baseplate and the anode assembly of another embodiment of the cell according to the invention.

In the embodiment of FIG. 9, the baseplate 3 is of concrete, preferably a concrete in which the binder is a polyester resin which is resistant to the conditions ruling in the cell, and it is provided, at its lower part, with a rigid envelope 24 serving as a lost casing for pouring of the concrete and forming the walls of the slots 13. The envelope 24 is preferably made of a material which is resistant to the corrosive action of the electrolyte, for example a laminate of polyester reinforced with glass fibres.

Between the slots 13, the envelope 24 is perforated with openings in communication with recesses 25 formed in the concrete of the baseplate 3. The envelope 24 supports, within these recesses rigid metal plates 26, for example of steel. These plates 26 serve to support the heads of vertical bolts 27 which pass through the envelope 24 and the bars 14 supporting the anodes, and which are screwed into nuts 28 placed beneath the bars 14. By tightening the nuts 28 on the bolts 27, for example by means of an adjustable torque spanner, the compression of the elastic joints 17 in the trapezoidal slots 13 and against the metal bars 14 is regulated.

Figure 10:
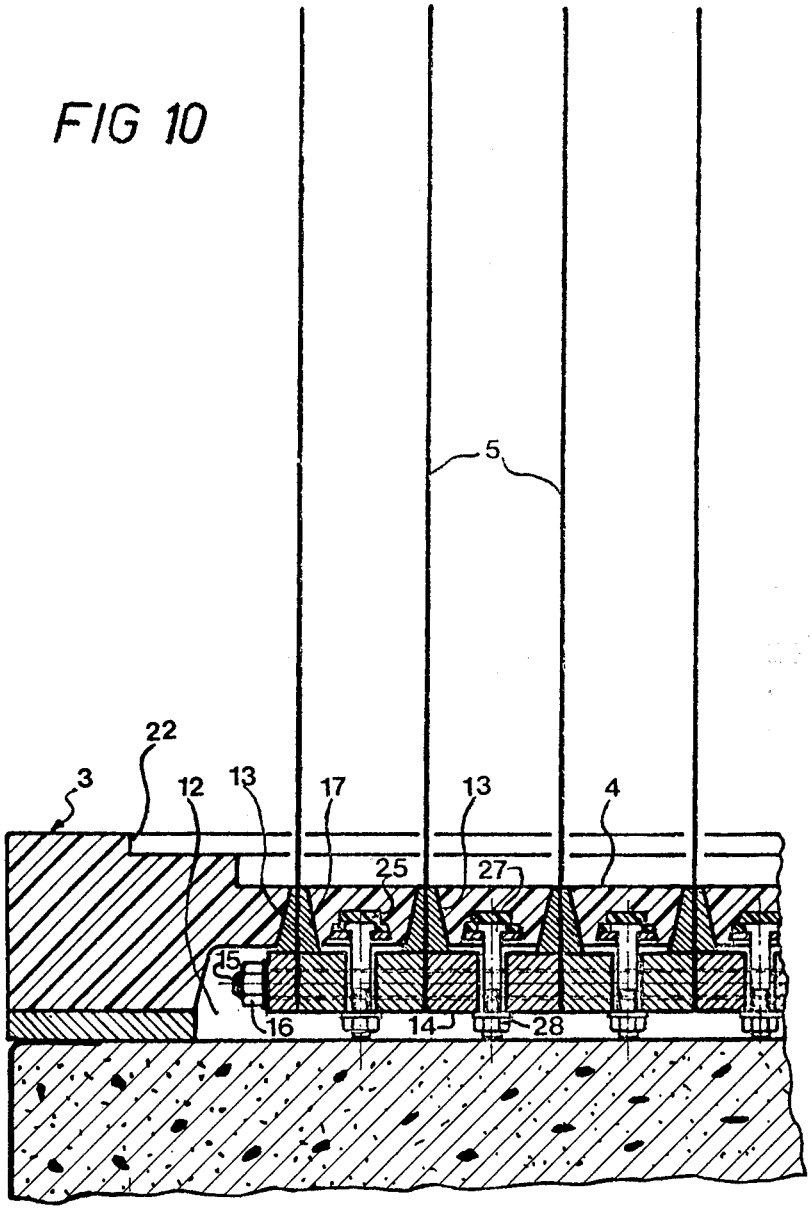
FIG. 10 is a view, analogous to FIG. 4, of a preferred embodiment of the cell according to the invention.

In a preferred embodiment of the invention, shown in FIG. 10, the baseplate 3 is formed from a laminate of polyester and glass fibres. Between the slots 13, the baseplate is pierced by recesses 25 containing metal plates 26 supporting, as in FIG. 9, bolts 27 which cooperate with nuts 28 to force the metal bars 14 against the trapezoidal joints 17 compressed around the anode plates 5, in the trapezoidal slots 13 of the baseplate 3. The recesses 25 are filled up with a malleable wax or some other malleable dough, designed to alow the bolts 27 to be turned on the baseplate 3 in order to facilitate their engagement in the openings provided for their reception through the bars 14.

In the cell of FIG. 10, the joints 17 are made of an elastomeric copolymer of ethylene and propylene and completely fill the slots 13 of the baseplate 3.

In the embodiments that have been described, the baseplate 3 of the cell according to the invention could equally well be made of a metal or an alloy resistant to the conditions ruling in the cell, for example of titanium, tantalum, niobium, tungsten, zirconium or an alloy of these metals. As a modification, they could be made of steel and covered with a protective sheet, for example a sheet of titanium or of chlorinated polyvinyl chloride.

In the foregoing description of the figures, the invention has been applied to diaphragm cells in which the anodes are thin plates, active on their two faces. It is nevertheless clear that the invention is also applicable to electrolytic cells in which the anodes are formed by pairs of vertical plates, disposed opposite to each other so as to form a box. In this particular case the anodes may be unperforated or foraminous.

Although, in the preceeding description, the invention has been applied to diaphragm cells, it is apparent that it is equally applicable to cells without a diaphragm, designed for example for the production of alkali metal hypochlorite or chlorate.

I claim:

1. Electrolytic cell comprising, a baseplate with slots passing therethrough, anode plates which pass through the slots in the baseplate, sealing joints in the slots of the base plate, between the anode plates and the faces of the slots, a current lead-in disposed beneath the base plate and electrically and mechanically connected to the anode plates in order to support said anode plates, and means for supporting said current lead-in beneath the cell, and said sealing joints being supported on said current lead-in and compressed between said current lead-in and the faces of said slots in the base plate.

2. Cell according to claim 1, characterised in that said joints are elastically compressed in the slots, between said anode plates and the current lead-in.

3. Cell according to claim 1, characterised in that said anode plates are supported in the cell by current lead-in.

4. Cell according to claim 1, characterised in that the current lead-in comprises metal bars extend between the anode plates and are clamped between these plates.

5. Cell according to claim 4, characterised in that the anode plates and the metal bars are divided into a plurality of distinct groups.

6. Cell according to claim 1, characterised in that the slots in the baseplate and the sealing joints have a trapezoidal cross section.

7. Cell according to claim 1, characterised in that the baseplate is monolithic.

8. Cell according to claim 1, characterised in that the baseplate is formed of a detachable and rigid group of beams parallel to the slots.

9. Cell according to claim 1, characterised in that the baseplate is pierced by at least one duct for ventilating the current lead-in.

10. Cell according to claim 1, characterised in that the baseplate is made of concrete having a binder comprising a corrosion-resistant polyester resin.

11. Cell according to claim 10, characertised in that the the baseplate is monolithic and poured into a prefabricated trough defining the lower surface of the baseplate and its slots.

12. Cell according to claim 1, characertised in that the baseplate is a laminate of polyester and glass fibres.

13. Cell according to claim 1, characertised in that the baseplate is made of a metal or an alloy of a metal of the group consisting of titanium, tantalum, niobium, tungsten and zirconium.

14. Cell according to claim 2, characterised in that the joints are compressed against the current lead-in under the action of the weight of the cell itself.

15. Cell according to claim 1, characterised in that the current lead-in is clamped against the sealing joints by means of an assembly of bolts and nuts, which connect the current lead-in to the baseplate.

16. Cell according to claim 15, characterised in that each bolt is suspended by its head from the baseplate, the head being movable within a recess formed in the baseplate between two consecutive slots, and the bolts is screwed into a nut which bears against the lower face of the current lead-in.

17. Cell according to claim 1, characterised in that the joints are made of an elastomeric copolymer of ethylene and propylene.

18. Cell according to claim 1, characterised in that the joints are made of an elastomeric copolymer of vinylidene fluoride and hexafluoropropene.

19. Cell according to claim 1, characterised in that, in the case where the cell comprises parallel rows of at least two anode plates placed in line with each other, the sealing joint surrounding the anode plates of a row comprises a strip pierced by axial slots, through each of which passes an anode plate.

20. Cell according to claim 1, characterised in that, in the case where the cell comprises parallel rows of at least two anode plates placed in line with each other, the sealing joint surrounding the anode plates of a row comprises a strip pierced by one axial slot, through which pass the row of anode plates and platelets which joint together these anode plates.

21. Cell according to claim 1, characterised in that the baseplate has a peripheral shoulder, a flexible joint interposed between the baseplate and the side walls of the cell, and said shoulder surrounding said flexible joint.

22. Cell according to claim 1, wherein the cell is a diaphragm cell for the production of chlorine by electrolysis of a brine.

* * * * *